US005398043A

United States Patent [19]

Takeda et al.

[11] Patent Number: 5,398,043

[45] Date of Patent: Mar. 14, 1995

[54] DRIVING METHOD FOR A DISPLAY DEVICE

[75] Inventors: Etsuya Takeda, Suita; Ichiro Yamashita, Katano; Takashi Tsukada, Hirakata; Katsumi Adachi, Kashiba, all of Japan

[73] Assignee: Matsushita Electric Industrial Co. Ltd., Osaka, Japan

[21] Appl. No.: 958,268

[22] Filed: Oct. 8, 1992

[30] Foreign Application Priority Data

Oct. 9, 1991 [JP] Japan ..... 3-261718

[51] Int. Cl.[6] ..... G09G 3/36

[52] U.S. Cl. ..... 345/94; 345/92

[58] Field of Search ..... 340/784, 805, 765, 811, 340/812, 813, 718, 719; 359/54, 59; 345/87, 92, 94, 96, 97

[56] References Cited

U.S. PATENT DOCUMENTS

| | | | |
|---|---|---|---|
| 4,386,352 | 5/1983 | Nonomura et al. | 359/59 |
| 4,393,380 | 7/1983 | Hosokawa et al. | 340/784 |
| 4,909,602 | 3/1990 | Kaneko | 340/784 |

FOREIGN PATENT DOCUMENTS

| | | |
|---|---|---|
| 0373565 | 6/1990 | European Pat. Off. . |
| 0448032 | 9/1991 | European Pat. Off. . |
| 60-3698 | 1/1985 | Japan . |
| 60-156095 | 8/1985 | Japan . |
| 61-275822 | 12/1986 | Japan . |
| 2-157815 | 6/1990 | Japan . |
| 3-222049 | 10/1991 | Japan . |

OTHER PUBLICATIONS

Y. Kaneko, et al. "A New Address Scheme to Improve the Display Quality of a-/Si TFT/LCD Panels", *IEEE Transactions on Electron Devices,* No. 12, pp. 2949–2952, (Dec., 1989).

T. Yanagisawa, K. Kasahara and M. Kajimura, "Compensation of the Display Electrode Voltage Distortion," *Proceedings of the 6th International Display Research Conference Japan Display '86,* pp. 192–195, Sep. 30–Oct. 2, 1986.

K. Suzuki, "Conpensative Addressing For Switching Distortion in A-Si TFTLCD", 1987.

*Primary Examiner*—Richard Hjerpe
*Assistant Examiner*—Chanh Nguyen
*Attorney, Agent, or Firm*—Ratner & Prestia

[57] ABSTRACT

A plurality of ON signal voltages are applied to a thin film transistor (TFT) within one field period, thereby transmitting an image signal voltage to a pixel electrode, two types of modulation signals are alternately supplied to a first wiring (17) at every field during an OFF period of the thin film transistor so that the potential of the pixel electrode is changed, and the change of the potential is superimposed on and/or offset by an image signal voltage so as to apply a resultant voltage to a display material to be driven. Before the termination of a first ON period of the plurality of ON signal voltages applied to the thin film transistor, a part of the potential of the modulation signal is varied.

8 Claims, 10 Drawing Sheets

DRIVING METHOD FOR A DISPLAY DEVICE

BACKGROUND OF THE INVENTION

1. Field of the Invention

The present invention relates to a method of driving a display device which displays a picture of image data by alternating-current driving (referred to as "AC-driving" hereinafter) a display material such as liquid crystals with A.C. power supply, using an active matrix which comprises switching elements such as thin film transistors (referred to as "TFT" hereinafter) and pixel electrodes, the switching elements and pixel electrodes being arranged in a form of a matrix.

2. Description of the Prior Art

Recently, quality of images displayed on an active matrix liquid crystal display (referred to as "LCD" hereinafter) has been remarkably improved to a degree comparable to that of a cathode ray tube (CRT). However, firstly, with regard to image quality, when considering the viewpoints of flickers, changes in brightness in a vertical direction of a screen (i.e., gradient brightness), tone representation and an image memory phenomenon in which a previous fixation image remains as if it is printed just after another fixation image has been displayed, the image quality of an active matrix LCD is not so improved as that of the CRT.

Several attempts have been made to provide a method capable of compensating D.C. voltage that is unavoidably generated in a display device due to dielectric anisotropy of a liquid crystal, reducing occurrence of flicker, thereby increasing the reliability of the driving performance. Two known methods as described above are disclosed in the following materials. One disclosure is "Japan Display" issued by T. Yanagisawa et al. in 1986 (p.192).

In this conventional method, the inevitably generated D.C. voltage in the display device is compensated by changing the amplitude of the positive and negative sides with respect to the amplitude center voltage (Vc) of an image signal voltage (Vs). In this conventional driving method, a scan signal exerts an effect on a potential of a pixel electrode through a parasitic capacitance Cgd existing between a gate and a drain of a TFT, resulting in causing a direct current (D.C.) potential difference between the average potential of a wiring for image signals and the average potential of the pixel electrode. When driving an LC material with A.C. power supply, if a potential at each part in the display device is set such that the average D.C. potential difference between the pixel electrode and the counter electrode becomes zero, the aforesaid D.C. potential difference will be raised inevitably between the wiring for image signals (referred to as "image signal line" hereinafter) and the counter electrode. The raised D.C. potential difference causes serious display defects such as the image memory phenomenon.

A method of compensating a D.C. potential difference completely and making it to be zero is disclosed in "Euro Display" issued by K. Suzuki in 1987 (P.107). In this second conventional method, the compensation of the D.C. potential difference is executed by applying a negative additional voltage signal (Ve) after applying a scan signal. LCDs have normally a feature of a small amount of power consumption for driving, however, in this conventional method, the amplitude of the analog signal is large so that a large amount of power consumption is required in the driving circuit (a degree of several hundreds of milli watts). Obviously, the power consumption required in this method is too large for portable-type display devices operated by dry batteries or the like.

With such a background, the present inventors have disclosed a method of "capacitive-coupling drive" in the Japanese Patent Application Laid Open No. 2-157815, published on June 18, 1990, wherein an internal D.C. voltage due to dielectric anisotropy in an LCD is compensated and the driving is performed with a small amount of power consumption. Further, the driving method disclosed in this material teaches a feature of capability of preventing occurrence of light blinking (i.e., flicker) in a screen by inverting a polarity of an image signal voltage at every scan line on a display screen. This feature was disclosed in the Japanese Patent Publication Laid-Open Nos. 60-3698 (1985), 60-156095 (1985) and 61-275822 (1986).

In recent years, there have been strong demands for providing wider screens for active LCDs and the ability of displaying more minute images with high quality. The charging time is getting shorter as more minuteness is achieved. For example, in an LCD for use at a work station, about 1,000 scan lines are used and the charging time per one scan line is 17 μseconds. This charging time is about one forth that of a small-sized liquid display television (TV) which has 240 scan lines and requires 60 μseconds for charging. A wider screen and more minute images cause another problem, that is, delays in scan signals. Such shorter charging time and delays in scan signals cause gradient brightness at the right and left sides of a screen.

In the above-mentioned method of "capacitive-coupling drive", such a signal delay leads to serious troubles.

In this conventional driving method, a gate signal delay causes a charging error that a source signal transmitted via the image signal line cannot be transmitted to the pixel electrode within a gate-ON time period, or causes a time delay until the gate voltage reaches an off-level so that the established electric charge leaks, causing a change in the pixel potential.

The charging rate of a pixel signal is proportional to the following equation.

$$((W/L*\mu*Cox)*(Vg-Vs-Vth))/Ct$$

where $Ct=Cs+Cgd+Csd+Clc$

Cs: storage capacitance
Cgd: gate-to-drain capacitance
Csd: source-to-drain capacitance
Clc: liquid crystal capacitance
W: channel width of TFT
L: channel length of TFT
μ: mobility
Cox: gate capacitance
Vg: gate voltage
Vs: signal voltage
Vth: threshold voltage of TFT Among the above factors, Ct is determined by the specification of an LCD. μ, Cox, Vth are virtually determined by the performance of a TFT. In the case of a small-sized LCD, a charge which exactly corresponds to a pixel signal can be established by setting W/L of a TFT to a large value.

Setting the W/L to a large value, however, makes the parasitic capacitance Cgd of the TFT large too, which increases the capacitance connected to the gate wiring, resulting in a considerable delay of gate signals. Therefore, there exists a value of W/L for maximizing the charging rate. With the value of W/L for maximizing the charging rate, a desired charging rate, however, cannot be achieved in a large-sized and high-precision LCD.

In order to solve the problem of charging errors, there has been proposed a method in the Japanese Patent Application Laid Open No. 3-222049, published on Oct. 1, 1991, in which a charge is preliminarily established to a vicinity of a desired voltage value by supplying a preliminary additional ON signal for precharge before supplying a substantial gate ON signal by 2 H ("H" represents a horizontal scanning period). However, it is not possible to obtain the effect of the preliminary charge by simply applying the above driving method to the aforementioned method of "capacitive-coupling drive" and, as a consequence, there occurs an error in the pixel potential.

SUMMARY OF THE INVENTION

It is therefore an essential object of the present invention to provide a method of driving a display device, enabling improvement in the display quality as well as in the driving reliability, and reducing the power consumption required for driving the display device. This improved method is also applicable for wider screens and displaying images with higher minuteness.

In order to accomplish the object mentioned above, a driving method of the present invention is characterized in that, in a display device which is provided with pixel electrodes arranged in a form of a matrix each connected through a capacitance to a first wiring, each pixel electrode also being connected to a TFT which is electrically connected to both an image signal wiring and a scan signal wiring, and an LC material held between the pixel electrode and a counter electrode is driven with A.C. power supply, the method comprises the steps of:

applying a plurality of gate ON signal voltages to the TFT within a period of one field to transmit an image signal voltage to the pixel electrode through the TFT;

supplying two types of modulation signals alternately to the first wiring at every field during a gate OFF period of the TFT so as to vary the potential of the pixel electrode; and superimposing the change of the pixel potential onto the image signal voltage and/or offsetting the change of the pixel potential with the image signal voltage by each other so that the superimposed and/or offset image signal voltage is applied to the LC material. In this method, a part of the potential of the modulation signal is changed before the termination of a first ON period of the gate ON signal voltages applied to the TFT.

In the case where a TFT is employed as a switching element for example, a potential change CgdVg of an image signal, which is induced by a potential change Vg in the scan signal by way of a gate-to-drain capacitance Cgd, is negatively generated. According to the present invention, asymmetric modulation signals Ve(+) and Ve(−), whose polarities are in an inverted relationship (positive and negative), are alternately applied at every field through a storage capacitance Cs so that there occurs, at the image electrode, a potential change CsVe(+)/Ct in the negative direction and a potential change CsVe(−)/Ct in the positive direction, and those potential changes on the image electrode are superimposed on the above potential change CgdVg/Ct of the image signal. The relationship between those potential changes can be set so as to satisfy the following equation.

$$\begin{aligned}(CsVe(+) + GgdVg)/Ct &= (CsVe(-) - CgdVg)/\mathrm{Ct} \\ &= \Delta V^*\end{aligned}$$

When the value of ΔV* is no less than the threshold voltage of the liquid crystal, the liquid crystal driving voltage is partially supplied from the capacitive-coupling potential and therefore the output amplitude of the image signal driver circuit can be reduced, saving driving power.

As a result, at least a part of D.C. components induced by the dielectric anisotropy of the liquid crystal and the scan signal by way of the gate-to-drain capacitance can be compensated, thereby eliminating causes of occurrence of troubles such as flicker and an image memory phenomenon. This ensures a high display quality and increases reliability for the driving operation of the LCD.

In order to reduce the delays in the gate voltage signals, the value of W/L of the TFT is decreased to reduce the capacitance connected to the gate wiring. A shortage of charge resulted from the reduction of the W/L is thought to be overcome by applying the plurality of ON signals to the gate voltage, but the effect of the ON signals has proved to decrease according to a potential change in the capacitor wiring to which a compensating voltage is applied when the method is used in combination with the method of "capacitive-coupling drive".

Further, the present inventors have found that the above effect can be achieved only when the voltage level of the middle modulation signal among the plurality of ON signals of compensating voltage is set to a specified voltage. As would be understood from the above description, the present invention has the following remarkable effects.

First, the output signal voltage of the signal driving circuit in the active matrix display device is considerably reduced so that the power consumption in the driving circuit for dealing with analog signals can be reduced. When the method of the present invention is applied to a color display, the output amplitude of a chroma IC can be reduced, thereby reducing the power consumption required in the driving circuit. Thus, it becomes possible to reduce the power consumption required for driving the overall display device. The reduction of the amplitude of the above output signal voltage facilitates the fabrication of driving circuits which have been growing in complexity since there are rising demands for high-density displays and high-frequency signal driving circuits. Furthermore, the invention has such a subsidiary advantage that it allows regions of good linearity in a signal amplifier to be utilized and this contributes to the improvement of the quality of images to be displayed.

Another advantage is an improvement in the quality of image to be displayed. The A.C. driving performed by applying A.C. modulation signals by every field makes it possible to eliminate the causes of occurrence of flicker. By adding a preliminary gate-ON signal, the size of the TFT can be reduced. In addition, remarkable improvement can be expected in the uniformity of the brightness of the display as well as in the tone representation.

Thirdly, the reliability of the LTD can be increased. This can be achieved by elimination of D.C. voltage which is unavoidably generated in the conventional display devices, the elimination being achieved by capacitive coupling or the like through the anisotropy of the liquid crystal and the scan signal Cgd. These D.C. voltage components cause various display defects in the conventional device. The elimination of D.C. voltage greatly contributes to reducing the image burning phenomenon which occurs just after displaying fixation images.

Further, the driving conditions depending on the equation (4) are not affected by the dielectric anisotropy of liquid crystals. This means that stable driving operation, which is free from the influence of changes in dielectric constant, can be achieved even when dielectric constant itself is changed in such a case as the display device is used in a wide range of temperature.

In the above description, the invention has been explained by way of a LCD, but it is needless to mention that the concept of the invention can be applied to driving of other plate display devices.

The present invention enables saving of electric power required in a display device, improvements in the image quality and the reliability, and therefore it exhibits remarkable industrial effects.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

The following describes preferred embodiments of the present invention with reference to the attached drawings.

Figure 1:
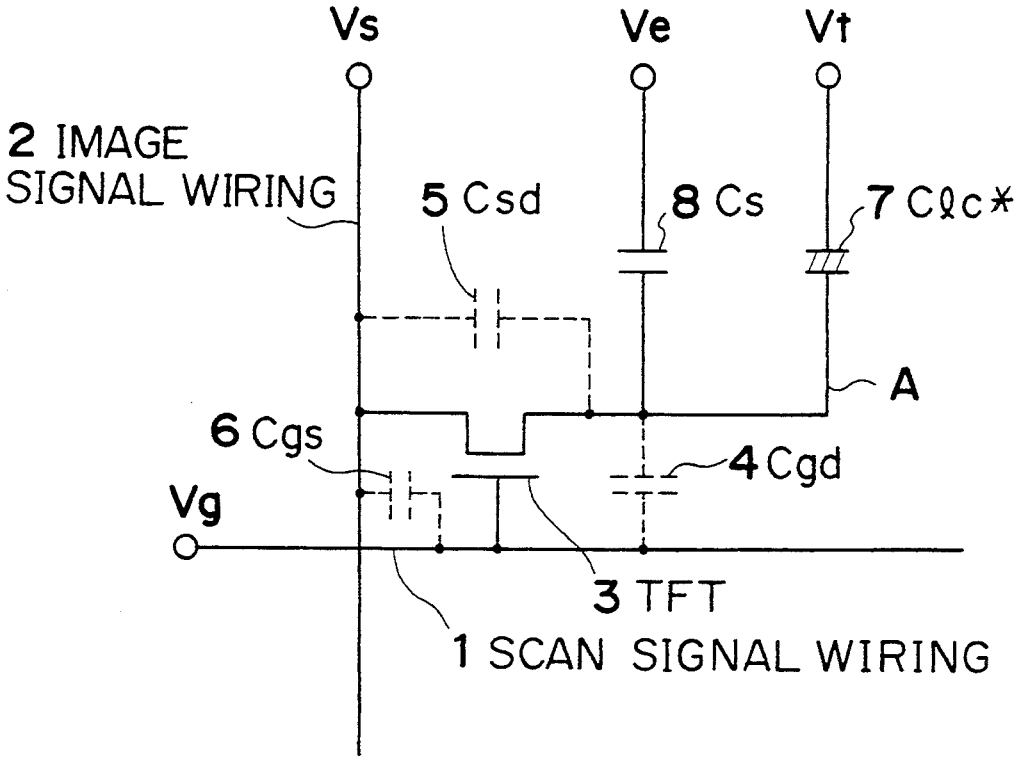
FIG. 1 is a circuit diagram showing an essential portion of the present invention for illustrating the principle of the invention.

FIG. 1 shows an electric equivalent circuit of each display element of a TFT active matrix driving LCD. Each display element has a TFT 3 interconnecting between a scan signal wiring 1 and an image signal wiring 2. The TFT 3 has a gate-to-drain capacitance Cgd 4, a source-to-drain capacitance Csd 5 and a gate-to-source capacitance Cgs 6, which serve as parasitic capacitances. As intentionally formed capacitances, there are further provided a liquid crystal capacitance Clc* 7 and a storage capacitance Cs 8.

A driving voltage is applied to each element electrode from an external portion. Specifically, a scan signal voltage Vg is applied to the scan signal wiring 1, an image signal voltage Vs is applied to the image signal wiring 2, a modulation signal Ve (Ve(+), Ve(−)) is applied to one electrode of the storage capacitance Cs in accordance with an image signal having its polarity inverted every field, and a constant counter voltage Vt is applied to the counter electrode of the liquid crystal capacitance Clc* for each field. When the TFT is in its OFF state, the potential of a pixel electrode is in an electrically floating condition. Therefore, the influences of the driving voltages appear on the pixel electrode (Point A in FIG. 1) through the aforementioned parasitic capacitances 4, 5 and 6 and intentionally formed capacitances 7 and 8. This potential change ΔV is represented by the following equation.

$$\Delta V = \Sigma \Delta Vi^{*} Ci/Ct$$

where ΔVi indicates a potential change in each of the electrodes coupled through the capacitances to the pixel electrode;

Ci indicates the capacitance value of each of the electrodes coupled through the capacitances to the pixel electrode; and $$Ct = Cs + Cgd + Csd + Clc.$$

As understood from the above description, during the period of the OFF state of the TFT, the pixel potential is affected by potential changes of the various electrodes coupled through the capacitances to the pixel electrode.

The potential change ΔV* of the pixel electrode due to coupling through the capacitances are represented by the following equations (1) and (2) respectively in even fields and in odd fields (however, potential change components generated at Point A when the image signal wiring becomes conductive by turning on the TFT are ignored in those equations).

$$\Delta V^{*}+=(CsVe(+)+CgdVg\pm CsdVs)/Ct \quad (1)$$

$$\Delta V^{*}-=(CsVe(-)-CgdVg\pm CsdVs)/Ct \quad (2)$$

$$Ct=Cs+Cgd+Csd+Clc^{*}$$

In each of the above equations, the second term (CgdVg) represents a potential change induced at the pixel electrode by the scan signal Vg by way of the parasitic capacitance Cgd 4 of the TFT. The first term (CsVe) represents the effect of a first modulation voltage (Ve). The third term (CsdVs) represents a potential change induced at the pixel electrode by an image signal voltage by way of the parasitic capacitance Csd 5. Clc* represents a capacitance of the liquid crystal which varies under the influence of the dielectric anisotropy of the liquid crystal as the orientation of the liquid crystal changes according to the amount of the image signal voltage (Vs). Accordingly, the capacitance Clc* and the potential change ΔV* correspond to a high capacitance (Clc(h)) of the liquid crystal and a low capacitance (Clc(l)) of the liquid crystal respectively. (It is noted that although Cgs 6 is a capacitance between the gate and the source i.e. image signal electrode, it will be ignored herein since the scan signal wiring 1 and the image signal wiring 2 are driven by a low impedance power supply and the coupling through this capacitance Cgs does not directly affect the potential of the pixel electrode.)

When the potential changes ΔV*+and ΔV*−in the even and odd fields are made equal to each other, it becomes possible to compensate for the D.C. potential fluctuation at the pixel electrode (point A) caused by the scan signal Vg by way of the parasitic capacitance Cgd 4. Thus, no D.C. voltage is applied to the liquid crystal so that a symmetric A.C. drive can be achieved. This means that the following equation is satisfied.

$$(CsVe(+)+CgdVg-CsdVs)=(CsVe(-)-CgdVg-CsdVs) \quad (3)$$

Since the image signal voltage Vs is inverted every scan line, the effect of the third term (CsdVs) in the equations (1) and (2) will be offset at each field. The above equation (3) is therefore simplified as follows.

$$(CsVe(+)+CgdVg)=(CsVe(-)-CgdVg) \quad (4)$$

At this point, there are several points that should be noted. The first point is that, at the pixel electrode, the positive and negative potential changes ΔV*(+) and ΔV*(−) with respect to the counter electrode are equally induced for the even fields and odd fields, irrespective of the capacitance Clc* of the liquid crystal.

Secondly, the capacitance Clc* of the liquid crystal does not appear in the equations (3) and (4). More specifically, if the LCD is driven under the condition that satisfies the equations (3) and (4), the influence of the dielectric anisotropy of the liquid crystal disappears, and there is not generated a D.C. voltage caused by the capacitance Clc* in the LCD.

The third point is that, when the compensation voltages Ve(+) and Ve(−) are set under such a driving condition that satisfies the equations (3) and (4), the scan signal Vg offsets a D.C. potential induced between the image signal wiring 2 and the pixel electrode by way of the parasitic capacitance Cgd 4 so that the value of the D.C. potential can be made zero. In the driving method according to the invention, there is supplied a signal whose polarity is inverted at every field with respect to the potential of the counter electrode so that it is understood when regarding to two fields that there is not generated a D.C. electric field in the potentials at the pixel electrode, signal electrode and counter electrode. As has been described above, no D.C. voltage is applied to the liquid crystal and this could be a great advantage for the reliability.

The last point to be noted is that the equations (3) and (4) have two voltage parameters Ve(+) and Ve(−) that can be set to desirable values in the display device. Therefore, the potential fluctuation ΔV* which appears at the pixel electrode can be so controlled as to be a desired value by controlling Ve(+) and Ve(−) according to the equations (3) and (4). When the potential fluctuation ΔV* is set to a value which is no less than the threshold voltage of the liquid crystal, the image signal voltage Vs can be reduced. Moreover, the reduction of Vs allows to reduce the output amplitude of an image signal driving circuit for controlling analog signals, reducing the power consumption used in the above circuit in proportion to the square of the amplitude. Similarly, in the case that the method is applied to a color display, the power consumption required in the chroma IC in which analog signals are dealt with can be reduced. The modulation voltage Ve is in a form of digital signals and the above chroma IC is ON/OFF controlled. Therefore, even when the modulations signals Ve(+) and Ve(−) are applied, the overall power consumption used in the driving system made up of complementary MOSICs can be reduced.

The following describes approximate values for the above capacitances and voltage parameters employed in the embodiments to be described later.

$$Cs=0.68\ pF,\ Clc(h)=0.226\ pF,\ Clc(1)=0.130\ pF,$$

$$Cgd=0.059\ pF,\ Csd=0.001\ pF,\ Vg=15.5\ V,$$

$$Ve(+)=-2.5\ V,\ Ve(-)=+4.9\ V,\ Vt=0\ V,$$

$$Vs=\pm 2.0\ V$$

Taking the above parameters into account, the third term CsdVs of the equation (3) can be virtually ignored and as a result, the following equation (4) is obtained.

$$(Ve(-)-Ve(+))=2\ CgdVg/Cs \quad (4a)$$

First Embodiment

Figure 4:
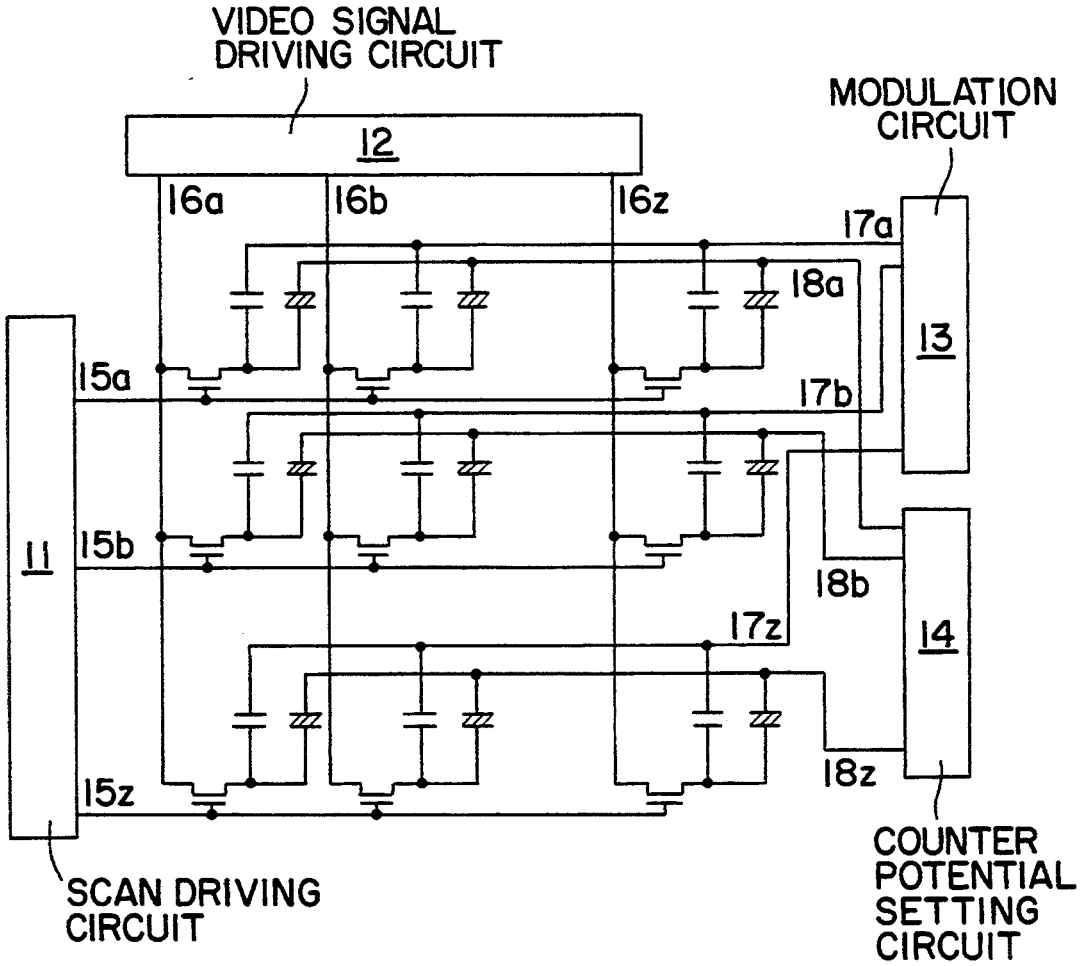
FIG. 4 is a circuit diagram showing the basic structure of a driving device according to a first embodiment of the invention.

FIG. 4 shows a circuit arrangement of a display device according to a first embodiment of the invention. Designated by reference numeral 11 is a scan driving circuit, numeral 12 is a video signal driving circuit, numeral 13 is a modulation circuit, and numeral 14 is a counter potential setting circuit. Numerals 15*a*, 15*b* to 15*z* denote scan signal wirings (represented by 15 hereinafter), numerals 16*a*, 16*b* to 16*z* denote image signal wirings (represented by 16 hereinafter), numerals 17*a*, 17*b* to 17*z* (represented by 17 hereinafter) denote modulation signal wirings serving as common electrodes of storage capacitances Cs, and numerals 18*a*, 18*b* to 18*z* (represented by 18 hereinafter) denote counter voltage line serving as counter electrodes of liquid crystals.

In the first embodiment, the storage capacitances Cs and the counter electrodes 18 are independently provided for every scan signal wiring 15 and a corresponding modulation signal is applied to each scan signal wiring 15. When the scan signal Vg, counter voltage Vt and image signal voltage Vs, and modulation signal Ve, which have been defined in FIGS. 2(*a*) to 2(*c*) as the variation components of voltage associated with an n-th scan line, are respectively applied to each point in FIG. 4, a potential change as shown in FIG. 2(*d*) will be seen in the pixel potential Vp applied to the liquid crystal.

Figure 2:
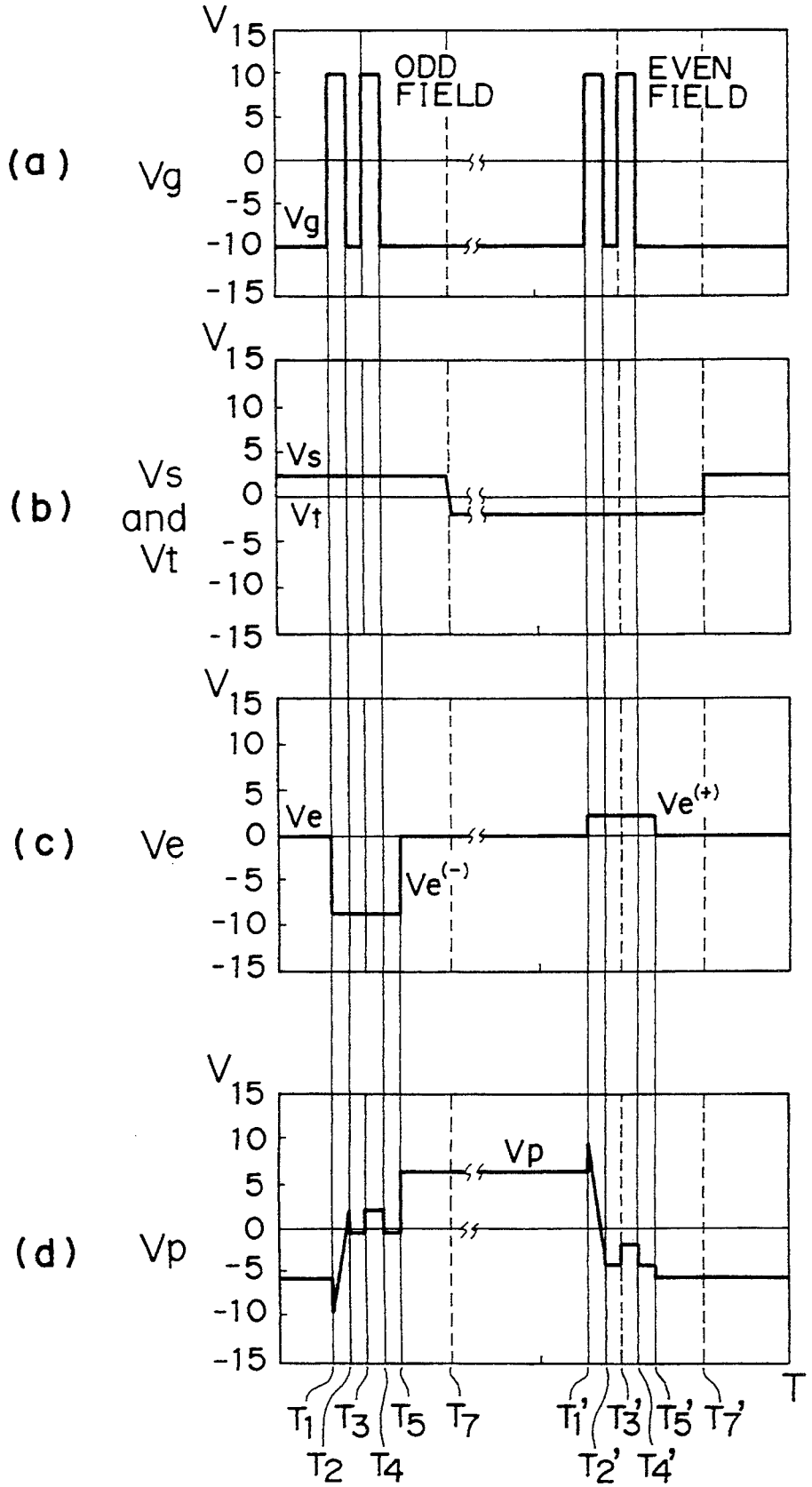
FIG. 2 shows waveform charts of voltages applied to the basic structure shown in FIG. 1, wherein (a) is associated with a gate voltage Vg, (b) a signal voltage Vs and a counter voltage Vt, (c) a modulation voltage Ve, and (d) a pixel potential Vp.

It should be noted that the potential of the capacitance wiring is preliminarily changed before termination of a preliminary gate ON signal (in this embodiment, the first pulse signal of the gate voltage Vg at T=T1 in FIG. 2(*a*)). In this embodiment, the preliminary gate ON signal is applied at T1, and then at T2 the pixel potential has the same value as that of an (n−2)-th pixel signal, which is proximate to the potential of the n-th pixel signal. It is noted here that, although only the first pulse signal is defined as the preliminary gate ON voltage, a plurality of preliminary gate ON voltages may be used before the substantial gate ON period.

When the preliminary gate ON signal is turned OFF (T=T2), the pixel potential once decreases because of the potential change of the gate, but when the gate voltage pulse signal is turned ON again at T3, the pixel potential has a value equal to the (n−2)-th pixel potential and then easily reaches a value equal to the n-th source signal at T4. Thereafter, the pixel potential decreases as the gate voltage is turned OFF at T4. Then, the compensation voltage Ve(−) is applied at T5 and the potential change ΔV*+is superimposed on the image signal voltage in the positive direction so that the pixel potential has a final value. The pixel potential is kept at the final value during the same field. In the next field, the same changes are repeated until T4′, and at T5′, the compensation voltage Ve(+) is applied and the potential change ΔV*−is superimposed on the signal voltage, thereby obtaining a target value in the field.

Figure 3:
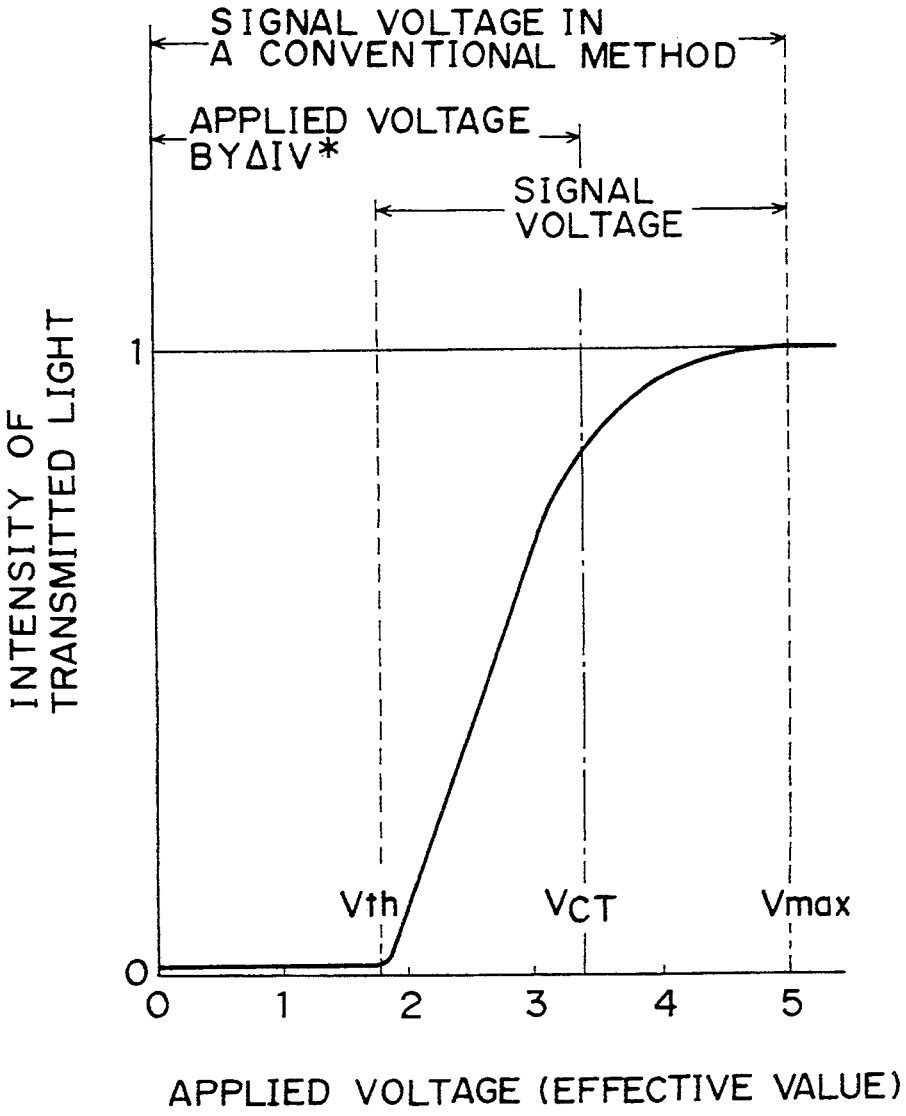
FIG. 3 is a graph showing a relationship between intensity of transmitted light of a liquid crystal and an applied voltage, and the effects of the voltage according to the present invention.

FIG. 3 shows the relationship between the applied voltage and the intensity of transmitted light through the liquid crystal, as well as an example of the voltage range within which the transmitted light is controlled by ΔV* and Vs. The voltage range for varying the transmitted light through the liquid crystal is from the threshold voltage Vth to the saturated voltage Vmax of the liquid crystal. When the potential change ΔV* sets the voltage to the threshold Vth or more and no phase control is performed, the necessary maximum signal voltage is (Vmax−Vth). When the applied voltage by ΔV* is set to Vct and the amplitude and phase of the signal voltage are controlled, the necessary maximum signal amplitude voltage can be reduced to about (Vmax−Vth)/2. As has been described above, the reduction of the amplitude of the image signal, which is one of the objects of the invention, can be thus accomplished.

Figure 5:
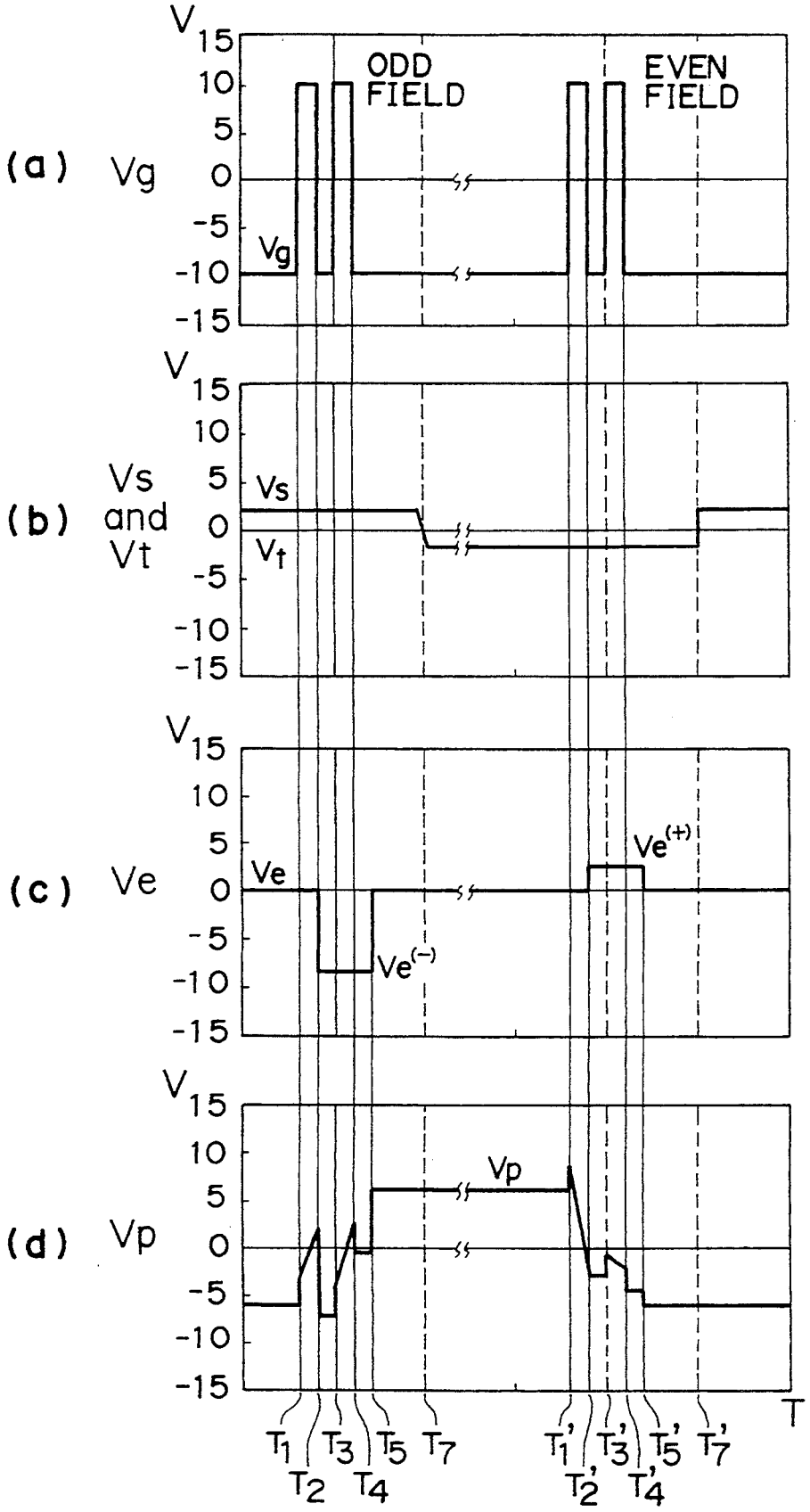
FIG. 5 shows waveform charts of applied voltages for making a comparison with the first embodiment, (a) being associated with a gate voltage Vg, (b) a signal voltage Vs and a counter voltage Vt, (c) a modulation voltage Ve, and (d) a pixel potential Vp.
Figure 6:
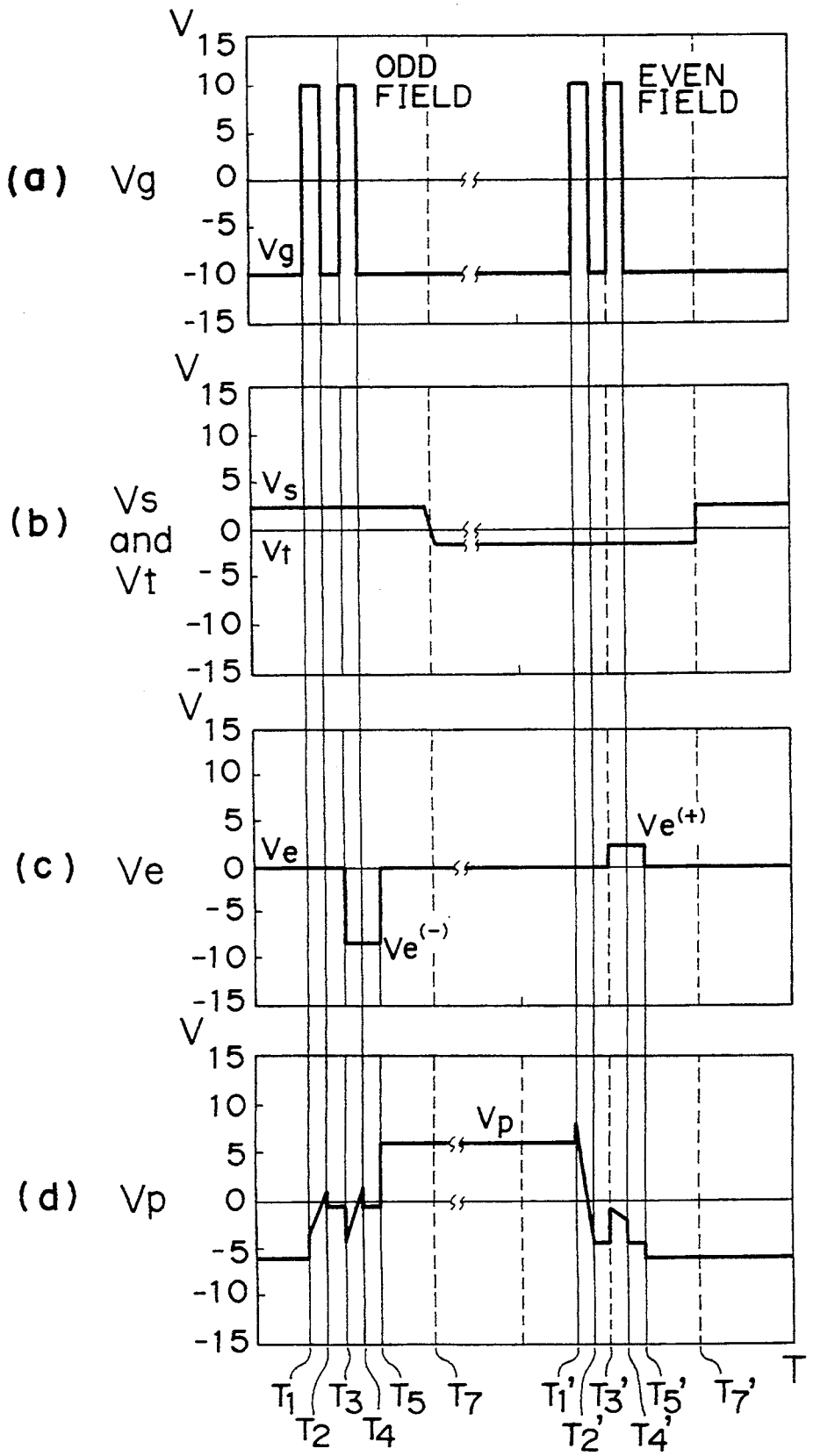
FIG. 6 shows waveform charts of applied voltages for making a comparison with the first embodiment, (a) being associated with a gate voltage Vg, (b) a signal voltage Vs and a counter voltage Vt, (c) a modulation voltage Ve, and (d) a pixel potential Vp.

FIGS. 5 and 6 show examples for comparison, in which with the gate voltage, signal voltage and counter voltage being kept like those of FIG. 2, the timing of presetting the modulation voltage is varied. The basic difference is that the modulation voltage Ve in FIG. 5(*c*) sets the modulation voltage immediately after termination of the preliminary gate ON period (in this case, T=T2), and the modulation voltage Ve in FIG. 6(*c*) sets the modulation voltage before termination of the substantial gate ON period (in this case, T=T3). In both cases, in spite of the fact that the voltage is raised to the (n−2)-th source voltage when T=T2, charging for obtaining a voltage for turning the substantial gate voltage ON when T=T4 has to be started from the potential which is distant from the (n−2)-th voltage close to the n-th source voltage. It, therefore, turns to be useless to preset to the (n−2)-th potential with a preliminary gate ON voltage.

It would be appreciated from the above description that the setting of a modulation voltage to be applied to the capacitance wiring should be preliminarily done before termination of the preliminary gate ON signal.

Second Embodiment

Figure 7:
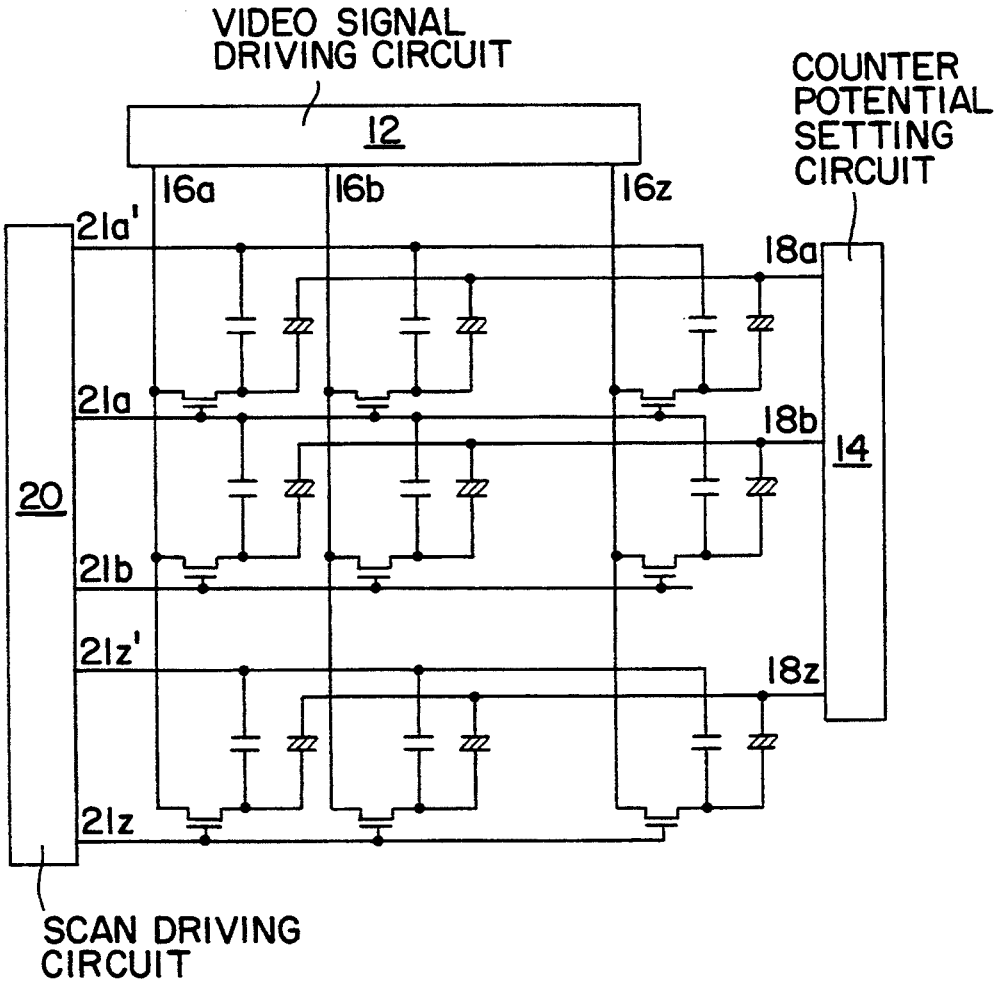
FIG. 7 is a circuit diagram showing the basic structure of a driving device according to a second embodiment of the invention.
Figure 8:
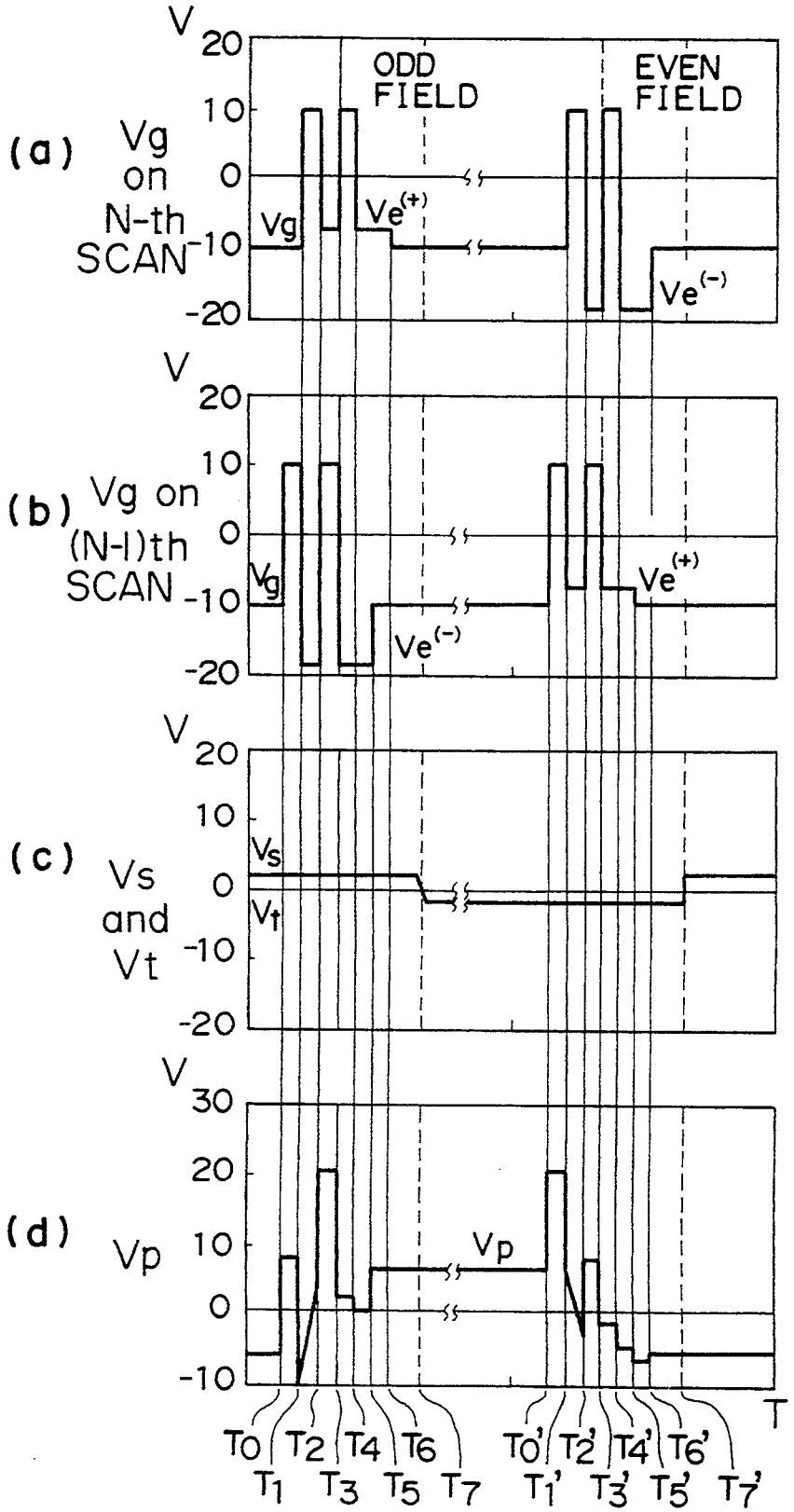
FIG. 8 shows waveform charts of applied voltages in the second embodiment, (a) being associated with a gate voltage Vg of a wiring for an n-th scan signal, (b) a gate voltage Vg of a wiring for an (n−1)-th scan signal, (c) a signal voltage Vs and a counter voltage Vt, and (d) a pixel potential Vp.

FIG. 7 shows a circuit arrangement according to a second embodiment of the invention and FIG. 8 shows the waveforms of voltages to be applied to the above circuit. Reference numeral 20 denotes a scan driving circuit capable of superimposing the modulation signal Ve. In FIG. 7, numeral 21*a* denotes a first scan signal wiring, numeral 21*a*′ a common electrode wiring for the storage capacitances attached to the first scan signal wiring, numeral 21*z* a final scan signal wiring, numeral 21*z*′ a scan signal wiring prior to the final scan signal wiring. The second embodiment differs from the first embodiment in that the common electrode of the storage capacitances Cs is used in common as a scan signal wiring in the former step. Therefore, a modulation signal is applied to the former scan signal wiring.

As shown in FIG. 8(*a*) and (*b*), the potential between the preliminary gate ON signal and the substantial gate ON signal (i.e., the potential in the period from T2 to T3) is equal to the modulation setting potential after termination of the substantial gate ON signal (in the period from T4 to T6).

The inversion of the polarity of the modulation signal may be carried out in an overlapping manner with respect to the n-th and (n+1)-th scan signal wirings, and with respect to the even field and odd field. Alternatively, it may be carried out only with respect to every field. The amount of the potential change of the modulation signal Ve(+) in the positive direction and that Ve(−) in the negative direction are made independently variable.

In this embodiment, the preliminary gate ON signal is applied at T1, and the pixel potential becomes, at T2, a value equal to the potential of the (n−2)-th pixel signal which is close to the n-th potential. When the gate ON signal is turned OFF (T=T2), the pixel potential once increases because of the potential changes at the former gate and the current gate, and then becomes equal to the (n−2)-th pixel potential because the potentials at the former gate and at the current gate become equal to those just before T=T2, when the gate signal is again turned ON at T3. Then, the pixel potential easily reaches the value of the n-th source signal at T4. Thereafter, the pixel potential decreases as the gate voltage changes to OFF at T4, and then, at T5, the compensation voltage Ve(−) is applied and the potential change ΔV*+in the positive direction is superimposed on the signal voltage so that a final value of the pixel potential is obtained. This final value is kept during the period of the same field. In the next field, the same changes are repeated until T4′, and then at T5′, the compensation voltage Ve(+) is applied and the potential change ΔV*− is superimposed on the signal voltage so that the target value can be obtained in the field.

Figure 9:
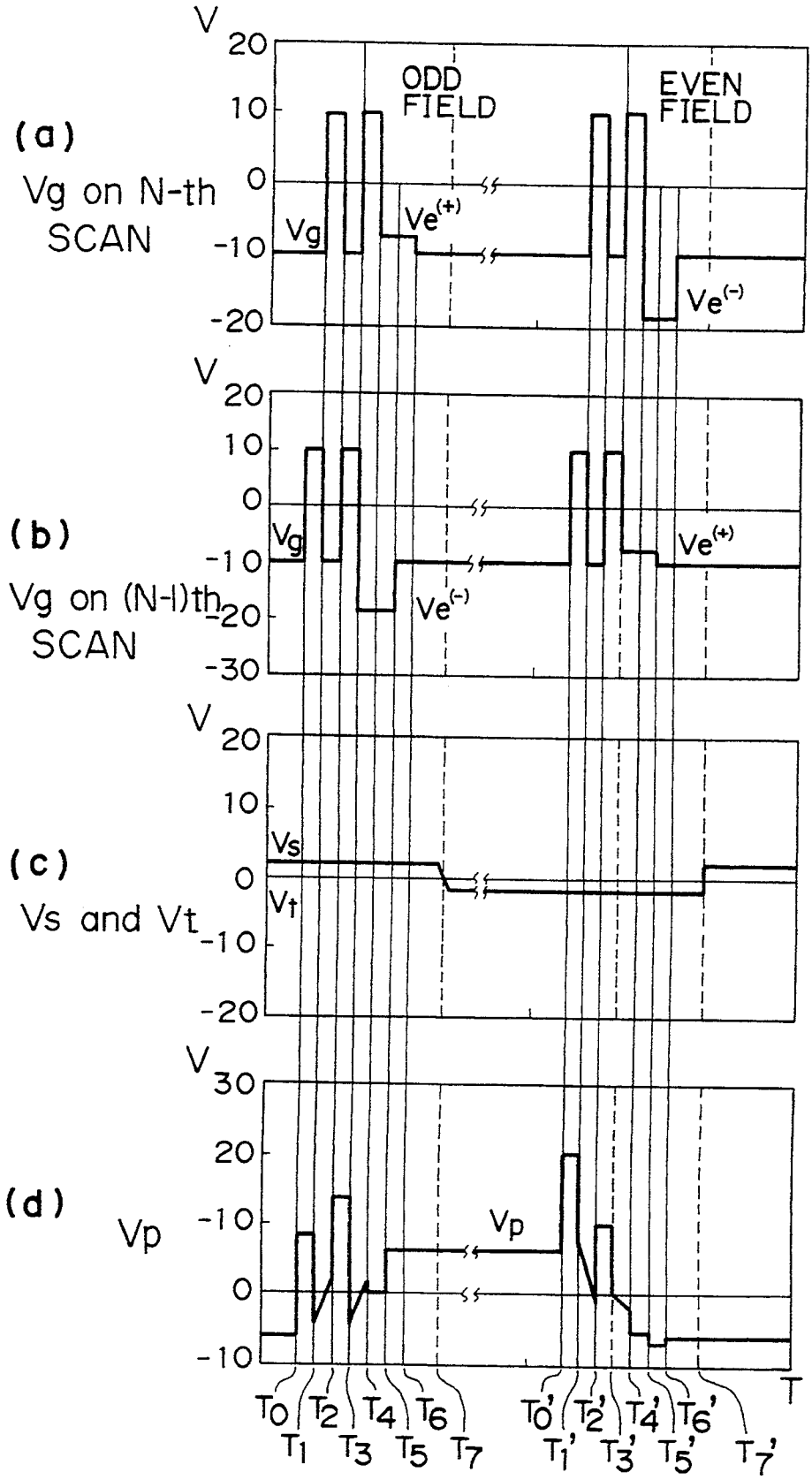
FIG. 9 shows waveform charts of applied voltages for making comparison with the second embodiment, (a) being associated with a gate voltage Vg of a wiring for an nth scan signal, (b) a gate voltage Vg of a wiring for an (n−1)th scan signal, (c) a signal voltage Vs and a counter voltage Vt, and (d) a pixel potential Vp.
Figure 10:
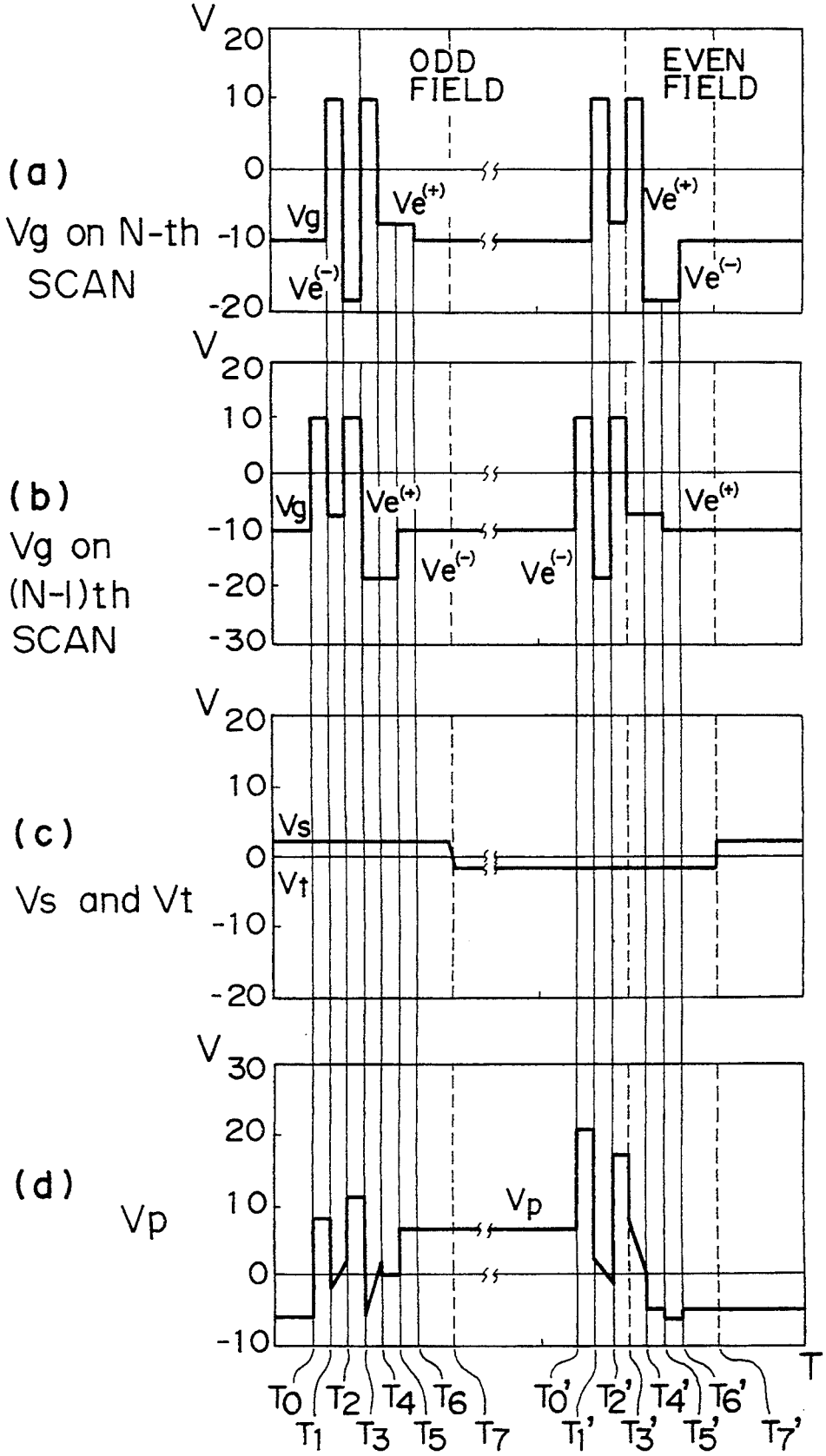
FIG. 10 shows waveform charts of applied voltages for making comparison with the second embodiment, (a) being associated with a gate voltage Vg of a wiring for an nth scan signal, (b) a gate voltage Vg of a wiring for an (n−1)th scan signal, (c) a signal voltage Vs and a counter voltage Vt, and (d) a pixel potential Vp.

FIGS. 9 and 10 show examples for comparison, wherein with the signal voltage and counter voltage being kept like those of FIG. 8, the pixel potential is varied in the two gate voltage ON periods. The basic difference is in that, in the gate voltages Vg in FIGS. 9(*a*) and 9(*b*), the potential between the first and second pulse signals of the gate ON voltages are set to equal to the potential of the gate OFF voltage. In the gate voltages Vg in FIGS. 10(*a*) and 10(*b*), the potential between the first (preliminary) and second (substantial) gate ON voltages is set to be a potential having a different polarity from the polarity of the voltage set after termination of the substantial gate ON period (e.g., Ve(+) for Ve(−)). In both cases, in spite of the fact that the voltage is raised to the (n−2)-th source voltage when T=T2, charging for obtaining a voltage for turning the substantial gate voltage ON when T=T4 has to be started from the potential which is distant from the (n−2)-th voltage close to the n-th source voltage. It, therefore, turns to be useless to preset to the (n−2)-th potential with the preliminary gate ON voltage.

It would be understood from the above description that the setting of a modulation voltage to be applied to the capacitance wiring is effectual when it is preliminarily executed before termination of the preliminary gate ON signal.

It would be also understood from the above that it is effectual that the potential between the preliminary gate ON signal and the substantial gate ON signal is set to be equal to a modulation setting potential after termination of the substantial gate ON signal.

In the second embodiment having the polarity of the potential of the pixel electrode varied every scan period, the influence of the dielectric anisotropy of the liquid crystal is compensated and a D.C. voltage which is generated between the image signal wiring and the pixel electrode can be compensated by adjusting Ve(+) and V(−). (As a consequence, the average potential of the image signals to be applied to the image signal wiring becomes equal to the average potential of the pixel electrode.) Thus, this embodiment makes it possible to eliminate main causes of occurrence of the flicker and image memory phenomenon, to increase the reliability of the driving operation, and to save driving power consumption. In this case, the tone controllability can be highly improved.

Further, the number of outputs from the power source can be reduced since the potential of the counter electrode can be kept constant.

Further, it is possible to eliminate generation of D.C. components in the LCD since the center Vsc of the signal voltage, the counter voltage Vtc and the center voltage Vpc of the pixel potential can be made equal.

A test was conducted on a display device to which the driving method of the invention had been applied. Fixation patterns such as window patterns, color bars, resolution charts were displayed and how the image memory phenomenon appeared was checked. After a window pattern was displayed for four hours with the method of the invention, the whole panel was brought into an intermediate tone display condition. The fixation pattern burning phenomenon was not observed in this test.

For comparison, the occurrence of the image burning phenomenon was checked when a conventional driving method was adopted. In this test, two types of panels were used. The first comparison panel does not have a storage capacitance for every pixel. In this panel, the internal D.C. potential difference induced between the signal bus and the pixel electrode through the parasitic capacitance Cgd by a scan signal applied to the gate was 3.5 to 4.0 volts. The burning phenomenon was clearly observed after displaying a window pattern on the first panel for three minutes. When displaying the same window pattern for one hour, the burning phenomenon was observed after that and did not disappear for about three hours. When another fixation pattern was displayed using the same panel, similar burning phenomenon was observed.

The second comparison panel has a storage capacitance of 1 pF for every pixel and the internal D.C. potential difference of 0.7 to 1.0 volts. On this panel, the burning phenomenon was not clearly observed after a fixation pattern had been displayed for a few minutes, but was observed after continuous displaying of the pattern for one hour, which was lasted for a couple of hours.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A driving method for a display device in which pixel electrodes each connected through a capacitance Cs to a first wiring for modulation signals are arranged in a form of a matrix, each of said pixel electrodes having transistor switching means the drain of which is electrically connected thereto, the source of which is electrically connected to an image signal wiring and the gate of which is electrically connected to a scan signal wiring, and said each of said pixel electrodes also being connected through a display material to a counter electrode for a counter voltage signal thereby to drive said display material with alternating current supply, said method comprising the steps of:

applying a plurality of ON signal voltages consisting of one or more preliminary ON signals and a substantial ON signal to said switching means for each row of said matrix, said plurality of ON signal voltages being applied within a horizontal scanning period for each row of said matrix, all of said rows of said matrix being scanned via said scan signal wirings within a period of one field so as to transmit an image signal voltage via said image signal wirings to said pixel electrodes by way of said turned on switching means;

supplying two types of modulation signals having different polarities alternately at every field to said first wirings during an OFF-period of said switching means;

varying a part of the potential of said modulation signals before termination of the preliminary ON period for precharge of said plurality of ON signal voltages applied to said switching means, thereby varying the potential of said pixel electrodes; and superimposing the change of the potential of said pixel electrodes onto said image signal voltage thereby to apply a resultant voltage to said display material to be driven.

2. The driving method according to claim 1, wherein the part of the potential of said modulation signals is varied after termination of the last ON period of said plurality of ON signal voltages applied to said switching means.

3. The driving method according to claim 1 or 2, wherein the potential of said modulation signals upon termination of the preliminary ON period for precharge of said plurality of ON signal voltages applied to said switching means is made equal to that upon starting of the last ON period thereof.

4. The driving method according to claim 1, wherein each of said first wirings has such an electrical structure serving as the scan signal wiring, and wherein the modulation signal is applied to said scan signal wiring while being superimposed on the scan signal.

5. The driving method according to claim 2, wherein each of said first wirings has such an electrical structure serving as the scan signal wiring, and wherein the modulation signal is applied to said scan signal wiring while being superimposed on the scan signal.

6. The driving method according to claim 3, wherein each of said first wirings has such an electrical structure serving as the scan signal wiring, and wherein the modulation signal is applied to said scan signal wiring while being superimposed on the scan signal.

7. The driving method according to claim 4, wherein the scan signal voltage during the middle period between the preliminary ON period and the substantial ON period of said plurality of ON signal voltages is set to the modulation voltage.

8. The driving method according to claim 4, wherein the image signal voltage transmitted during an ON period of said switching means inverts the polarity of the image signal voltage at every scan line on a display screen, and the polarity of said modulation signal applied to said first wiring during an OFF period of said switching means is inverted at every scan line.

* * * * *